United States Patent [19]

Davidson

[11] Patent Number: 4,552,448

[45] Date of Patent: Nov. 12, 1985

[54] SHEET TRANSPORT SYSTEM

[75] Inventor: James R. Davidson, Rochester, N.Y.

[73] Assignee: Xerox Corporation, Stamford, Conn.

[21] Appl. No.: 584,036

[22] Filed: Feb. 27, 1984

[51] Int. Cl.[4] ..... G03G 15/01; B65H 5/08

[52] U.S. Cl. ..... 355/3 SH; 271/277

[58] Field of Search ..... 355/3 SH, 14 SH, 4, 355/3 TR; 271/277, 82

[56] References Cited

U.S. PATENT DOCUMENTS

| | | | |
|---|---|---|---|
| 3,612,677 | 10/1971 | Langdon et al. | 355/4 |
| 4,135,927 | 1/1979 | Draugelis et al. | 355/4 |
| 4,138,102 | 2/1979 | Palmer | 271/82 |
| 4,326,792 | 4/1981 | Landa | 355/3 TR |

*Primary Examiner*—Laramie E. Askin
*Assistant Examiner*—David S. Warren
*Attorney, Agent, or Firm*—H. Fleischer; J. E. Beck; R. Zibelli

[57] ABSTRACT

An apparatus which advances a sheet into registration with information developed on a moving member. A sheet gripper transports the sheet in a recirculating path. The sheet gripper is detachably coupled to the member over a portion of the path of movement thereof to place the sheet in registration with the information developed on the member. Thereafter, the sheet gripper is decoupled from the member to move independently thereof.

5 Claims, 3 Drawing Figures

SHEET TRANSPORT SYSTEM

This invention relates generally to an electrophotographic printing machine, and more particularly concerns an apparatus for advancing a sheet into registration with information developed on a photoconductive member.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Multi-color electrophotographic printing is substantially identical to the heretofore discussed process of black and white printing. However, rather than forming a single latent image on the photoconductive surface, successive latent images corresponding to different colors are recorded thereon. Each single color electrostatic latent image is developed with toner particles of a color complementary thereto. This process is repeated a plurality of cycles for differently colored images and their respective complementarily colored toner particles. Each single color toner powder image is transferred to the copy sheet in superimposed registration with the prior toner powder image. This creates a multi-layered toner powder image on the copy sheet. Thereafter, the multi-layered toner powder image is permanently affixed to the copy sheet creating a color copy.

Hereinbefore, toner powder images have been transferred to the copy sheet by an electrical field created by a corona generating device of the type disclosed in U.S. Pat. No. 2,836,725, issued to Vyverberg in 1958. A corona generator of this type induces transfer to the copy sheet by spraying a corona discharge having a polarity opposite to that of the toner particles on the photoconductive surface. This causes the toner particles to be electrically transferred to the copy sheet. However, in transferring multiple toner powder images, each toner powder image must be in superimposed registration with one another in order to produce a color copy which is not blurred. In lieu of utilizing a corona generating device, an electrically biased transfer roll may be used. The biased transfer roll generates a high voltage discharge in the proximity of the surface of the copy sheet, or it may be applied by means of a conductive cylinder in contact with the copy sheet, as disclosed in U.S. Pat. No. 2,807,233, issued to Fitch in 1957. The copy sheet is interposed between the conductive roller and the photoconductive surface. A charge of opposite polarity from the toner particles is deposited on the back side of the copy sheet which attracts the toner particles therein. In either case, the copy sheet must be advanced in a recirculating path and the images transferred in registration with another. Various approaches have been devised to move the copy sheet in a recirculating path, the following disclosures appear to be relevant: U.S. Pat. No. 3,612,677; Patentee: Langdon et al.; Issued: Oct. 12, 1971: U.S. Pat. No. 4,326,792; Patentee: Landa; Issued: Apr. 27, 1982.

The pertinent portions of the foregoing disclosures may be briefly summarized as follows:

Langdon et al. describes an electrically biased transfer roll which employs gripper fingers to secure the copy sheet to the exterior surface thereof for movement therewith in a recirculating path.

Landa describes a gripper assembly mounted in the transfer roller of an electrophotographic printing machine. The gripper secures the leading edge of the copy sheet and maintains a grip on the sheet while the transfer roller rotates.

In accordance with one aspect of the present invention, there is provided an apparatus for advancing a sheet into registration with information developed on a moving member. Means are provided for transporting the sheet. Means detachable couple the transporting means to the member with the transporting means being decoupled from the member over a portion of the path of movement to move independently thereof. The transporting means is coupled to the member over a portion of the path of movement thereof to place the sheet in registration with the information developed on the member.

Pursuant to another aspect of the present invention, there is provided an electrophotographic printing machine of the type having a toner powder image developed on a moving photoconductive member with a sheet being advanced into registration with the toner powder image developed on the photoconductive member. Means are provided for transporting the sheet. Means detachable couple the transporting means to the photoconductive member with the transporting means being decoupled from the photoconductive member over a portion of the path of movement to move independently thereof. The transporting means is coupled to the photoconductive member over a portion of the path of movement thereof to place the sheet in registration with the information developed on the photoconductive member.

Other aspects of the present invention will become apparent as the following description proceeds and upon reference to the drawings, in which.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference therein.

Figure 1:
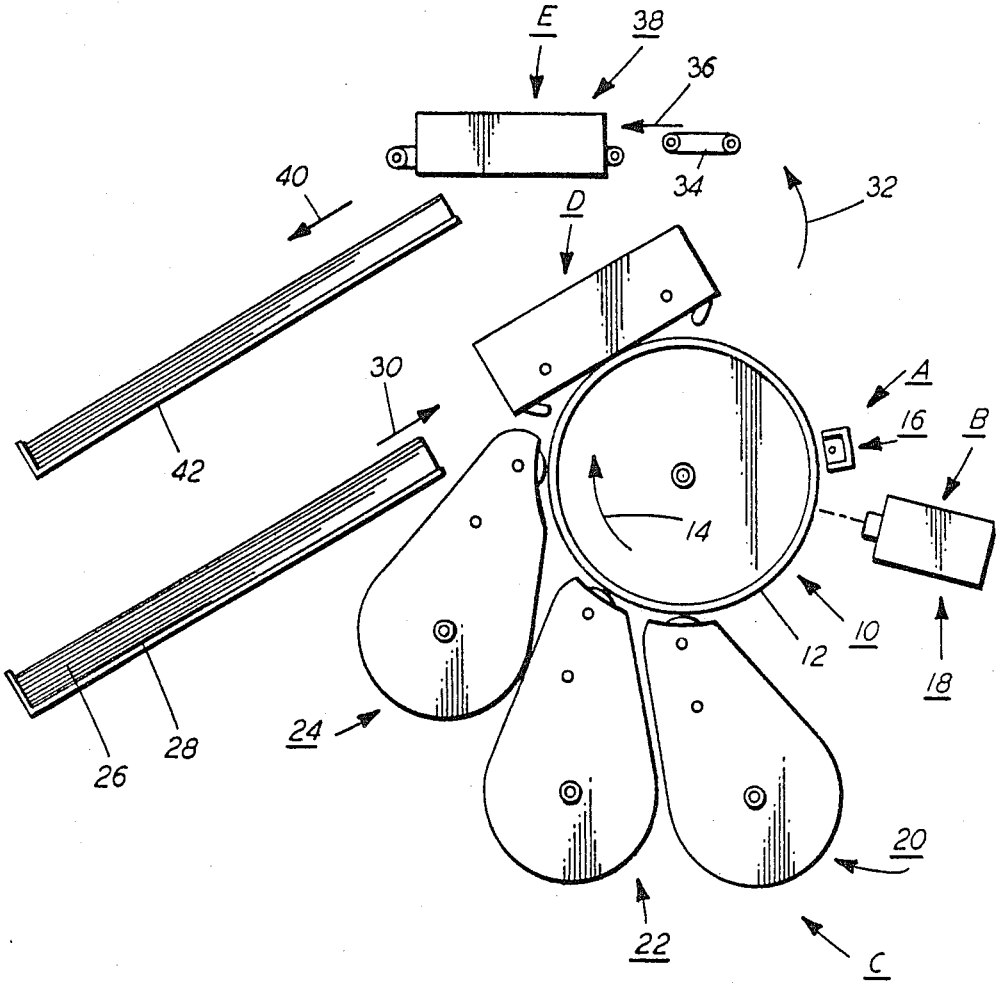
FIG. 1 is a schematic elevational view depicting an electrophotographic printing machine incorporating the features of the present invention therein.

As shown in FIG. 1, the illustrative electrophotographic printing machine employs a drum 10 having a photoconductive surface 12. Preferably, photoconductive surface 12 comprises a selenium alloy adhering to a conductive substrate, e.g. an electrically grounded aluminum alloy. Drum 10 moves in the direction of arrow 14 to advance photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Thereafter, drum 10 rotates the charged portion of photoconductive surface 12 to imaging station B. At imaging station B, a filtered light image of an original document is projected onto the charged portion of photoconductive surface 12. A moving lens system, and a color filter mechanism move in a timed relationship with drum 10 to scan successive incremental areas of the original document disposed upon a transparent platen. Lamps, located beneath the platen, illuminate successive incremental areas of the original document. A suitable moving lens system is described in U.S. Pat. No. 3,062,108 issued to Mayo in 1952. Similarly, U.S. Pat. No. 3,775,006 issued to Hartman et al. in 1973 discloses a filter mechanism. Finally, U.S. Pat. No. 3,592,531 issued to McCrobie in 1971 discloses a suitable type of lens. The foregoing elements cooperate with one another to produce a single color light image of the original document which is projected onto the charge portion of photoconductive surface 12 selectively dissipating the charge thereon to record a single color electrostatic latent image. Alternatively, a laser system may be employed in lieu of an optical system. The laser beam is modulated and forms a light image corresponding to one of the colors desired in the copy. Thus, the information initially recorded on the photoconductive surface by the laser system would correspond to the information desired to be reproduced in one color. The foregoing process is repeated for each color.

After the electrostatic latent image is recorded on photoconductive surface 12, drum 10 rotates the latent image to development station C. At development station C, three individual developer units, generally designated by the reference numerals 20, 22, and 24, respectively, render successive electrostatic latent images visible. A suitable development station for use in a color electrophotographic printing machine is disclosed in U.S. Pat. No. 3,854,449 issued to Davidson in 1974. Each of the developer units described therein are of a type referred to in the art as "magnetic brush developer units". In general, a magnetic brush developer unit employs a developer mix of ferromagnetic carrier granules having toner particles triboelectrically attracted thereto. Each developer unit forms a directional flux field to continually create a magnetic brush of developer mix. This brush of developer mix is brought into contact with the latent image recorded on the photoconductive surface 12. Toner particles are attracted from the carrier granules to the latent image by the greater electrostatic force thereof. Thus, the latent image is developed or rendered visible by the toner particles. Developer units 20, 22 and 24, respectively, contain differently colored toner particles. Each of the toner particles contained in the respective developer unit corresponds to the complement of the single color light image transmitted through each of the differently colored filters of the filter mechanism used in optical system 18. As an illustration, a latent image formed by a green filtered light image is developed with green absorbing magenta toner particles. Similarly, latent images formed by blue and red images are developed with yellow and cyan toner particles, respectively. If desired, a fourth developer unit having black toner particles may be used as well.

With continued reference to FIG. 1, drum 10 is next rotated to transfer station D where the toner powder image adhering electrostatically to photoconductive surface 12 is transferred to a copy sheet. The copy sheet may be plain paper, or a sheet of thermoplastic material, amongst others. The copy sheet is advanced from a stack of copy sheets 26 disposed upon tray 28. A sheet feeder separates and advances the uppermost sheet from stack 26. The sheet moves in the direction of arrow 30 to transfer station D. At transfer station D, a sheet advancing mechanism moves the sheet therethrough in a recirculating path. A corona generating device sprays ions onto the back side of the sheet to attract the toner powder image thereto. Inasmuch as the copy sheet moves in a recirculating path, successive toner powder images are transferred thereto in superimposed registration with one another. The detailed structure of transfer station D will be described hereinafter with reference to FIGS. 2 and 3. After the last toner powder image has been transferred to the copy sheet, the copy sheet advances in the direction of arrow 32 onto conveyor 34. Conveyor 34 advances the copy sheet with the toner powder image adhering thereto, in the direction of arrow 36, to fusing station E.

At fusing station E, a fuser, indicated generally by the reference numeral 38, supplies sufficient heat to permanently affix the toner powder images transferred to the copy sheet. One suitably type of fusing apparatus is described in U.S. Pat. No. 3,907,492 issued to Draugelis et al. in 1975. After the fusing process, the copy sheet is advanced in the direction of arrow 40 to catch tray 42 for subsequent removal therefrom by the machine operator.

Invariably, after the transfer process, residual toner particles remain adhering to photoconductive surface 12. These residual toner particles are removed from photoconductive surface 12 at a cleaning station (not shown). The cleaning station includes a pre-clean corona generating device for neutralizing the charge on photoconductive surface 12 and that of the residual toner particles. This enables a fibrous brush in contact with the photoconductive surface to remove these residual toner particles therefrom. A suitable brush cleaning system is described in U.S. Pat. No. 3,590,412 issued to Gerbasi in 1971.

It is believed that the foregoing description is sufficient for purposes of the present application to depict the general operation of an electrophotographic printing machine embodying the teachings of the present invention therein.

Figure 2:
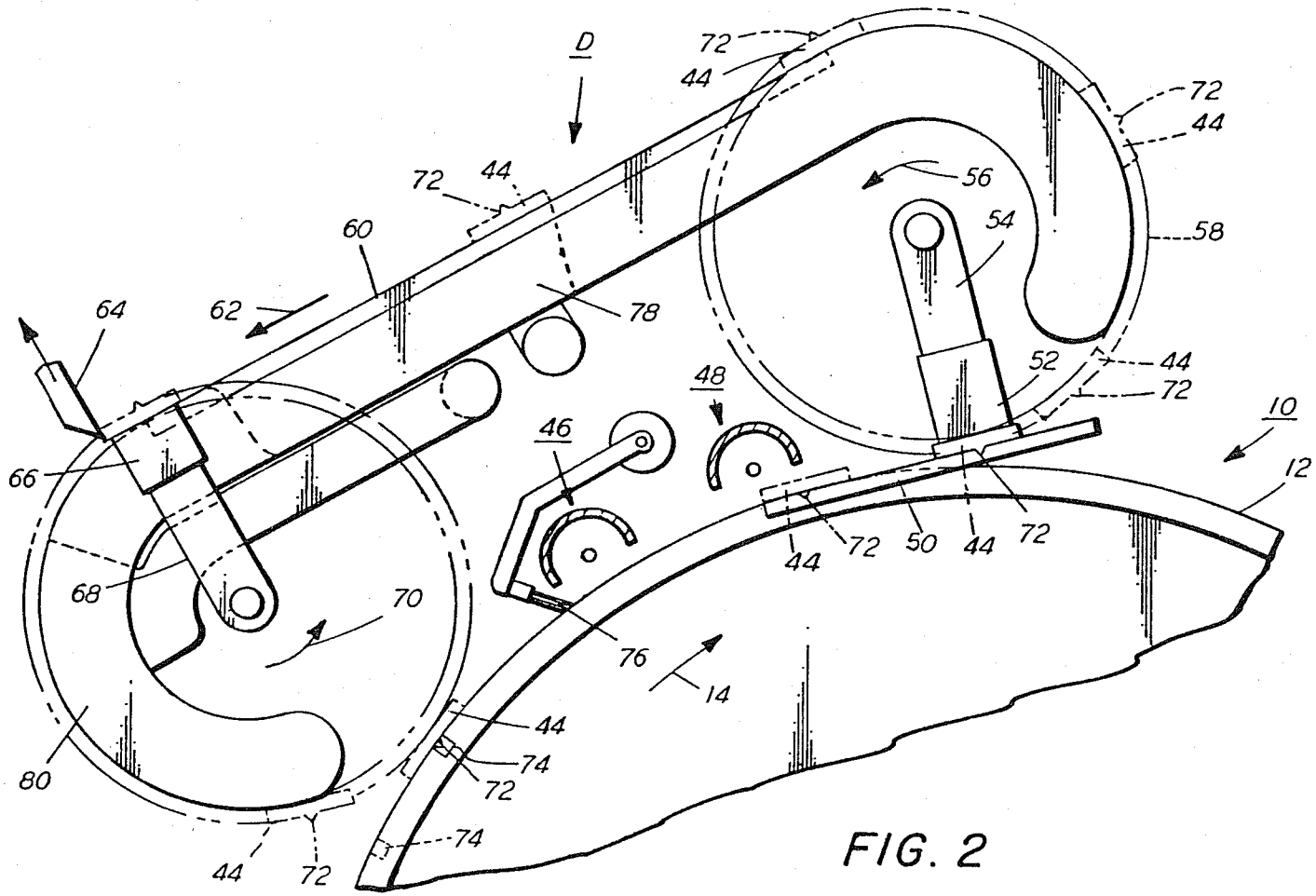
FIG. 2 depicts the detailed structure of the copy sheet transport and the registration thereof with the developed image on the photoconductive member.

Turning now to the specific subject matter of the present invention, FIG. 2 depicts transfer station D in greater detail. As shown in FIG. 2, gripper bar 44 is detachably coupled to drum 10 to move in unison therewith. Gripper bar 44 advances the copy sheet beneath transfer corona generator 46 which sprays ions onto the back side thereof. This transfers the toner powder image from drum 10 to the copy sheet. Thereafter, gripper bar 44 advances the copy sheet to pass beneath detack corona generator 48. The copy sheet is secured releasably to gripper bar 44. The copy sheet advances with drum 10 so that the toner powder image transfers to the copy sheet. As gripper bar 44 advances with drum 10 in the direction of arrow 14, it encounters ramp 50. Ramp 50 detaches gripper bar 44 from drum 10. Gripper bar 44 advances along ramp 50, being at this time pushed by the copy sheet adhering electrostatically to drum 10, until it passes beneath electromagnet 52 secured to a pivotably mounted arm 54. At this time, i.e. when gripper bar 44 reaches a preselected point along ramp 50, electromagnet 52 is energized securing gripper bar 44 thereto. Simultaneously, a motor (not shown) coupled to arm 54 is energized rotating arm 54 in the direction of arrow 56. Arm 54 rotates at an angular velocity such that the tangential velocity of gripper bar 44 is equal to or slightly less than that of drum 10. The copy sheet, by its inherent stiffness, will follow the arcuate path that gripper bar 44 moves through, as shown by the dashed lines 58. After rotating through approximately 180°, gripper bar 44 engages the surface of slide 60. At this time, electromagnet 52 is de-energized. Gripper bar 44 moves along slide 60 in the direction of arrow 62 due to the gravitational force exerted thereon. As shown in FIG. 2, slide 60 is at approximately a 30° angle with the coefficient of friction between gripper bar 44 and the surface of slide 60 being less than 0.5. The weight of gripper bar 44 will exert a slight tension force on the copy sheet to advance it in the direction of arrow 62 as well. At the lowermost end of slide 60, stop 64 will prevent, momentarily, gripper bar 44 from continuing to advance. An electromagnet 66 secured to arm 68 is now actuated and gripper bar 44 secured thereto. A motor coupled to arm 68 is energized, in a timed sequence with the angular rotation of drum 10, to rotate in the direction of arrow 70. The angular velocity of arm 68 is such that the tangential velocity of gripper bar 44 is substantially the same as that of drum 10, at the circumferentially surface thereof. This may be achieved by having the shaft carrying arm 68 controlled with respect to the shaft supporting drum 10 by a shaft encoder coupled by phase-lock circuitry to a drum shaft encoder. However, one skilled in the art will appreciate that many other techniques may also be employed in lieu thereof. As gripper bar 44 approaches drum 10, protrusions or pins 72 extending outwardly therefrom are precisely aligned with registration apertures or holes 74 in drum 10. Once gripper bar 44 is coupled to drum 10, it will be advanced by drum 10 back through the foregoing cycle to have the next successive toner powder image transferred to the copy sheet. Brush 76 will be pivoted and mechanically controlled to be raised away from gripper bar 44 while gripper bar 44 passes therebeneath and to move downwardly to engage the copy sheet after gripper bar 44 passes. Brush 76 will once again be lifted away when the trail edge of the copy sheet approaches. To control the copy sheet, two vacuum platens 78 and 80 are provided. Each vacuum platen has its own controls associated therewith to provide a slight vacuum during specific portions of movement of the copy sheet. Vacuum platen 78, positioned beneath slide 60, will be actuated when the trail edge of the copy sheet passes beneath detack corona generating device 48. This vacuum provides sufficient friction to prevent any skewing of the paper when released from drum 10. When the trail edge of the copy sheet starts to pass across vacuum platen 78, vacuum platen 80 is energized. This will prevent the remainder of the copy sheet from falling until the trailing marginal region approaches the point where gripper bar 44 is coupled to drum 10. The foregoing describes the path of movement of the copy sheet at transfer station D so as to enable a plurality of toner powder images to be transferred thereto in superimposed registration. After the requisite number of toner powder images have been transferred thereto, in superimposed registration with one another, the copy sheet continues to advance to fusing station E. The foregoing is more fully described with reference to FIG. 3.

Figure 3:
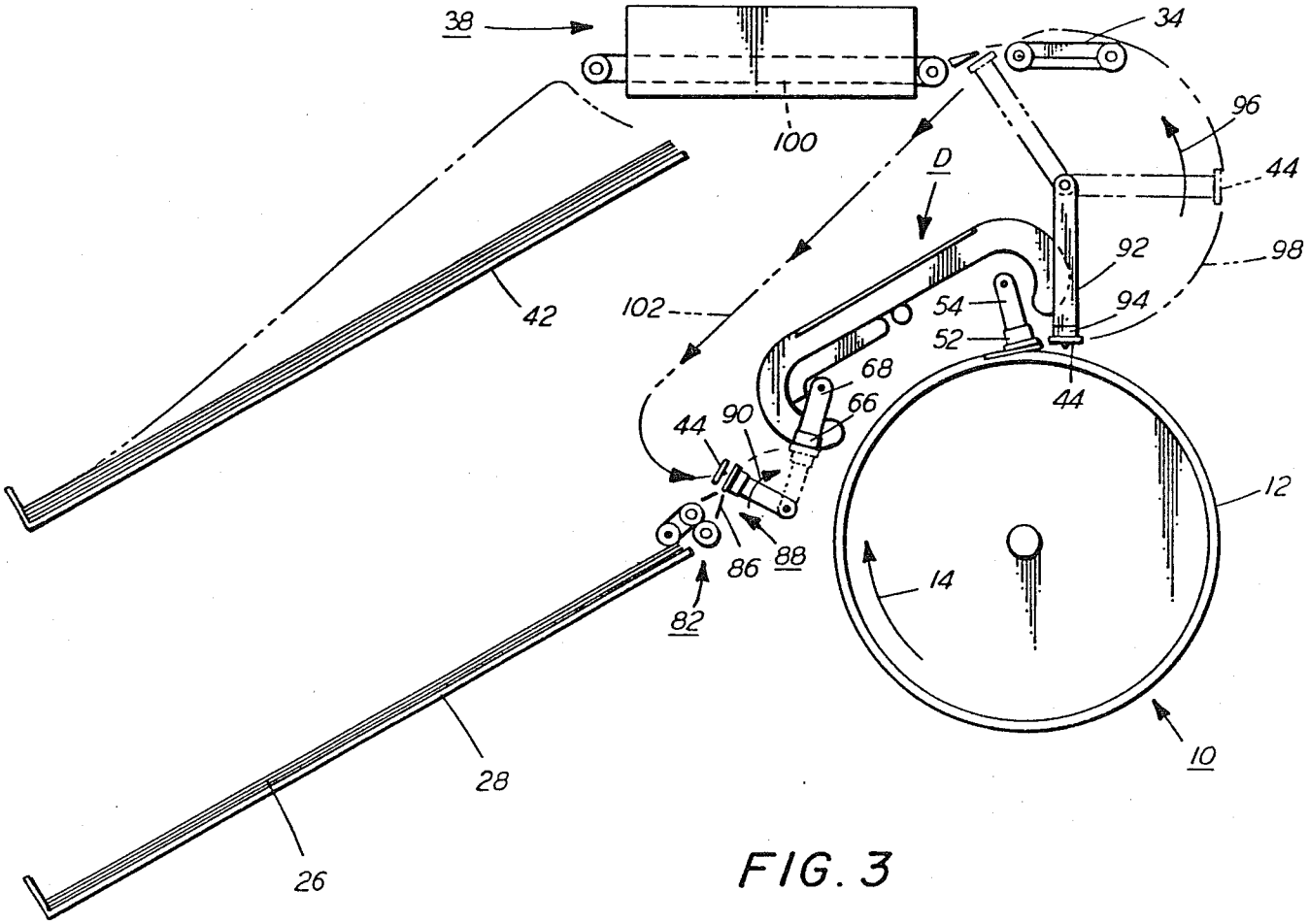
FIG. 3 shows the copy sheet path.

Referring now to FIG. 3, a copy sheet is advanced from stack 26 on tray 28 by sheet feeder 82. Chute 86 guides the advancing sheet into gripper bar 44, which is held in a stationary position at the loading station with the gripper fingers open. Gripper bar 44 is held by an electromagnet secured to an arm, indicated generally by the reference numeral 88. After the lead edge of the copy sheet is secured to gripper bar 44, the gripper fingers are closed. At the appropriate time in the machine cycle, arm 88 is rotated in the direction of arrow 90 to move gripper bar 44 into contact with electromagnet 66 on arm 68. Electromagnet 66 is energized to secure gripper bar 44 thereto. The energization of the electromagnet is timed such that the movement of gripper bar 44 will be in synchronism with that of drum 10 to insure that the pins in gripper bar 44 register with the holes in drum 10. The copy sheet will be advanced beneath the transfer corona generator and detack corona generator and through a recirculating path as heretofore described with regard to FIG. 2. After the required number of toner powder images have been transfered to the copy sheet, the lead edge of the copy sheet will be permitted to slide gripper bar 44 to a position wherein arm 92 having electromagnet 94 secured thereto will receive gripper bar 44. At this time, electromagnet 94 is energized. A motor (not shown) rotates arm 92 in the direction of arrow 96 to move the gripper bar through the arc indicated generally by dashed lines 98. Gripper bar 44 is advanced by arm 92 to conveyor 34. At this time, the gripper fingers open and the vacuum platen associated with conveyor belt 34 secures the copy sheet thereto. Conveyor belt 34 advances the copy sheet to fuser 38 where conveyor belt 100 advances the sheet therethrough to catch tray 42 for subsequent removal from the printing machine by the operator thereof. After gripper bar 44 has released the copy sheet, it moves to a storage location adjacent arm 88 so as to be ready to receive the next copy sheet. A belt or chain conveyor may be employed to advance gripper bar 44 along the path indicated generally by dash lines 102 to a storage position closely adjacent to arm 88 for receiving the next copy sheet. After releasing gripper bar 44, arm 92 rotates in a direction opposed to arrow 96 to return to its positions for receiving the next gripper bar 44 after it leaves drum 10.

In recapitulation, it is clear that the gripper bar moves through a recirculating path with a copy sheet attached thereto. A plurality of toner powder images are transferred to the copy sheet in superimposed registration. The registration of successive toner powder images is insured by the positive coupling of the gripper bars to the photoconductive drum during successive transfer operations. Thus, the gripper bar is always in engagement with the photoconductive drum at exactly the same point, i.e. the point dictated by the pin extending outwardly from the gripper bar meshing with the hole in the photoconductive drum. One skilled in the art will appreciate that a pin may extend outwardly from the drum and mesh with an aperture in the gripper bar in lieu of the coupling structure heretofore described. This insures that very close tolerances may be maintained between successive toner powder images minimizing any blurring due to misregistration.

It is, therefore, evident there has been provided in accordance with the present invention, an apparatus for advancing a sheet into registration with information developed on a photoconductive surface. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An electrophotographic printing machine of the type having a toner powder image developed on a moving photoconductive member with a sheet being advanced into registration with the toner powder image developed on the photoconductive member, including:

means for transporting the sheet; and means for detachably coupling said transporting means to the photoconductive member with said transporting means being decoupled from the photoconductive member over a portion of the path of movement to move independently thereof and coupled thereto over a portion of the path of movement thereof to place the sheet in registration with the information developed on the photoconductive member.

2. A printing machine according to claim 1, wherein said transporting means includes:

a sheet gripper; and means for advancing said sheet gripper in a recirculating path of movement.

3. A printing machine according to claim 2, wherein said coupling means includes:

a protuberance extending outwardly from said sheet gripper; and an aperture in the photoconductive member adapted to mesh with said protuberance.

4. A printing machine according to claim 1, further including means for transferring the developed image from the photoconductive member to the sheet in registration therewith.

5. A printing machine according to claim 4, wherein:

said sheet gripper transports the sheet through a recirculating path; and said transferring means transfers a plurality of developed images, in superimposed registration with one another, from the photoconductive member to the sheet.

* * * * *